US008311251B2

(12) United States Patent
Gommel et al.

(10) Patent No.: US 8,311,251 B2
(45) Date of Patent: Nov. 13, 2012

(54) ELECTRONIC APPARATUS FOR CONNECTION TO A HEARING APPARATUS COMPONENT WITH A TWO-PART SLEEVE

(75) Inventors: Uli Gommel, Erlangen (DE); Daniela Hertel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 300 days.

(21) Appl. No.: 12/732,429

(22) Filed: Mar. 26, 2010

(65) Prior Publication Data

US 2010/0246870 A1 Sep. 30, 2010

(30) Foreign Application Priority Data

Mar. 26, 2009 (DE) ..... 10 2009 015 005

(51) Int. Cl.
*H04R 25/00* (2006.01)

(52) U.S. Cl. ..... 381/322; 381/328; 381/324; 381/330

(58) Field of Classification Search ..... 381/322, 381/328, 330, 312, 324
See application file for complete search history.

(56) References Cited

U.S. PATENT DOCUMENTS

| | | | | |
|---|---|---|---|---|
| 4,727,582 | A * | 2/1988 | de Vries et al. | 381/330 |
| 4,785,827 | A | 11/1988 | Fischer | |
| 2001/0043707 | A1 * | 11/2001 | Leedom | 381/312 |
| 2004/0240695 | A1 | 12/2004 | Leedom et al. | |
| 2008/0031481 | A1 * | 2/2008 | Warren et al. | 381/322 |
| 2008/0205679 | A1 * | 8/2008 | Darbut et al. | 381/328 |
| 2008/0298618 | A1 * | 12/2008 | Baumann et al. | 381/325 |
| 2009/0041261 | A1 | 2/2009 | Fickweiler et al. | |
| 2009/0092270 | A1 * | 4/2009 | Ho et al. | 381/324 |
| 2009/0304216 | A1 | 12/2009 | Hansen | |
| 2010/0128905 | A1 * | 5/2010 | Warren et al. | 381/312 |

FOREIGN PATENT DOCUMENTS

| | | | |
|---|---|---|---|
| DE | 202005012668 | U1 | 12/2006 |
| DE | 10 2007 037 024 | A1 | 2/2009 |
| WO | 0169973 | A2 | 9/2001 |
| WO | 2008095489 | A1 | 8/2008 |

OTHER PUBLICATIONS

European Search Report date Jun. 17, 2010.

* cited by examiner

*Primary Examiner* — Mohamad Musleh
*Assistant Examiner* — Mangtin Lian
(74) *Attorney, Agent, or Firm* — Laurence A. Greenberg; Werner H. Stemer; Ralph E. Locher

(57) ABSTRACT

An electronic component and, in particular, an external receiver of a hearing aid, are intended to be capable of being configured to be simpler and more robust. To this end, it is proposed that the electronic apparatus, which has an electronic component and a cable which is connected to the electronic component, is equipped with a first sleeve which is arranged around a part of the electronic component and a part of the cable and mechanically connects the two, and a second sleeve, which surrounds another part of the electronic component. The first sleeve and the second sleeve are coaxially directly connected to one another such that both sleeves together also completely surround the electronic component in the axial direction. The two sleeves can possibly be connected to one another by laser welding.

10 Claims, 4 Drawing Sheets

ELECTRONIC APPARATUS FOR CONNECTION TO A HEARING APPARATUS COMPONENT WITH A TWO-PART SLEEVE

CROSS-REFERENCE TO RELATED APPLICATION

This application claims the priority, under 35 U.S.C. §119, of German application DE 10 2009 015 005.6, filed Mar. 26, 2009; the prior application is herewith incorporated by reference in its entirety.

BACKGROUND OF THE INVENTION

Field of the Invention

The invention relates to an electronic apparatus for connection to a hearing apparatus component having an electronic component, a cable which is connected to the electronic component, a first sleeve which is arranged around a part of the electronic component and a part of the cable and mechanically connects the two, and a second sleeve, which surrounds another part of the electronic component. In this case, the expression hearing apparatus refers to any acoustic appliance which can be worn in or on the ear or on the head, in particular a hearing aid, a headset, earphones and the like.

Hearing aids are portable hearing apparatuses which are used for the deaf. In order to comply with the numerous individual requirements, different forms of hearing aids are provided, such as behind-the-ear hearing aids, a hearing aid with an external receiver (RIC: receiver in the canal) and in-the-ear hearing aids, for example also concha hearing aids or canal hearing aids. The hearing aids mentioned by way of example are worn on the outer ear or in the hearing canal. Furthermore, however, bone-conduction hearing aids are also commercially available, as well as hearing aids which can be implanted and vibrotactile hearing aids. In this case, the damaged hearing is stimulated either mechanically or electrically.

In principle, the major components of hearing aids are an input transducer, an amplifier and an output transducer. The input transducer is generally a sound receiver, for example a microphone, and/or an electromagnetic receiver, for example an induction coil. The output transducer is generally in the form of an electroacoustic transducer, for example a miniature loudspeaker, or an electromechanical transducer, for example a bone-conduction receiver. The amplifier is normally integrated in a signal processing unit. This basic design is illustrated in FIG. 1, using the example of a behind-the-ear hearing aid. One or more microphones 2 for receiving the sound from the surrounding area is or are installed in a hearing aid housing 1 to be worn behind the ear. A signal processing unit 3, which is likewise integrated in the hearing aid housing 1, processes the microphone signals, and amplifies them. The output signal from the signal processing unit 3 is transmitted to a loudspeaker or receiver 4, which emits an acoustic signal. The sound may be transmitted to the ear drum of the person wearing the appliance via a flexible sound tube, which is fixed to an otoplasty in the auditory canal. Power is supplied to the hearing aid and in particular to the signal processing unit 3 by a battery 5 which is likewise integrated in the hearing aid housing 1.

Hearing aids may be equipped with an external electronic component, arranged outside the housing. The need to connect external electronic components, such as loudspeakers, to a behind-the-ear hearing aid arises because of feedback or the space required. In the past, hearing aids with external receivers have been known, in which the electrical connecting lines for the in-the-ear loudspeaker 10 are passed to the hearing aid through a flexible molded tube 11, as shown in FIG. 2. This flexible molded tube 11 is firmly connected to a receiver inner housing 13 by a flexible tube end piece 16 with a first sleeve 12, with the receiver 10 being adhesively bonded in or being encapsulated.

The in-the-ear receiver 10 which is connected to the hearing aid must be configured by a further unit to the geometry of the ear canal, and to the acoustic requirements of the user. At the present time, flexible earpieces (domes) and individually matched earpieces (ear molds) are used for this purpose, although these are not illustrated in FIG. 2. The connection piece 14 (spout) between the receiver 10 or the receiver inner housing 13 and the earpiece must be as small as possible because of the space problems within the auditory canal, in order to allow the in-the-ear system to be used for as many customers as possible. Furthermore, one essential requirement is that the connection piece 14 is connected well to the plastic housing 13 in order to ensure that it does not break off when removed from the auditory canal, thus remaining stuck in the canal.

By way of example, published, non-prosecuted German patent application DE 10 2007 037 024 A1, corresponding to U.S. patent publication No. 2009/0041261 A1, discloses a hearing device for hearing aids having an external receiver. This has an earpiece with a hole into which the receiver is inserted. An elastic intermediate piece in this case holds the majority of the longitudinal extent of the receiver. For this purpose, the intermediate piece is pressed into the hole in the earpiece with a friction fit. The receiver that has been mounted in this way can thus be pushed out of the earpiece—for example for replacement—together with the intermediate piece, with the aid of a tool.

Published U.S. patent application No. 2008/0298618 A1 discloses an earpiece for a hearing apparatus having a securing ring. In order to hold earwax protection more securely in an earpiece of a hearing apparatus which can be worn in the ear, the earpiece is manufactured from an elastic material. It is produced together with a sound outlet opening and with earwax protection with an annular support. A safety ring in this case surrounds the sound outlet opening, and is permanently integrated in the earpiece. The sound outlet opening is thus stiffened, as a result of which the earwax protection cannot slide out it.

Because of the position of the in-the-ear receiver unit in the auditory canal, this unit is subject to loads resulting from contamination (earwax, sweat, etc). It is therefore necessary to fit contamination protection, in order to increase the life of the receiver unit.

The habits and well-being of hearing-aid wearers must always be taken into account for the improvement of hearing aids. It is therefore necessary to choose the materials which come into contact with the skin so as to achieve the best possible wearing comfort, while making it possible to cope with the mechanical loads.

Particular attention must be paid to the following features relating to the specific configuration of the external receiver, according to the example shown in FIG. 2. In order to connect the external receiver unit to the flexible molded tube 11 which is used as a guide for electrical connecting lines, as well as to the connecting piece 14 to the earpiece, three interfaces are generally required:

First, a connection 17 of the flexible molded tube 11 to a plastic holder 12, that is to say a first sleeve 12: the connection 17 is generally provided by inset-molding of the flexible tube 11 with a thermoplastic (holder).

Second, there is provided a connection 18 of the plastic holder 12 to a housing 13 of the receiver 10. This connection 18 is generally provided by an adhesive joint. One problem in this case is that a plastic surface must be adhesively bonded to a metal surface, if the receiver inner housing 13 is composed of metal. Because of the widely differing surface energies of these two materials, adhesive bonding is very difficult and in some cases is not reliable.

Third, a connection 19 between the receiver housing 13 and the connection piece 14 (spout) is provided. This connection 19 is generally formed by spot-welding a metal spout directly on the receiver or the receiver inner housing 13. This weld is not continuous and therefore exhibits a number of weak points.

One fundamental problem in this implementation of the external receiver unit with a plurality of interfaces is that the interface is subject to a risk of failure and a portion of the component can thus possibly remain stuck in the auditory canal when the receiver is removed. Since, furthermore, the receiver inner housing of the receiver is composed of metal and comes into direct contact with the skin, the receiver must be gold-plated in order to cope with biocompatibility and allergy problems. Furthermore, hearing-aid wearers have also found that direct contact between metals and the auditory canal is unpleasant. A further disadvantage is that the contamination protection 15 is generally a separate component. It generally contains a plastic membrane, or a plastic grid.

SUMMARY OF THE INVENTION

It is accordingly an object of the invention to provide an electronic apparatus for connection to a hearing apparatus component with a two-part sleeve which overcome the above-mentioned disadvantages of the prior art methods and devices of this general type, which is more robust and can be manufactured more easily.

According to the invention, the object is achieved by an electronic apparatus for connection to a hearing apparatus component. The electronic apparatus has an electronic component, a cable which is connected to the electronic component, a first sleeve which is arranged around a part of the electronic component and a part of the cable and mechanically connects the two, and a second sleeve, which surrounds another part of the electronic component. The first sleeve and the second sleeve are coaxially directly connected to one another such that both sleeves together also completely surround the electronic component in the axial direction.

This advantageously now means that only one housing interface is required, that is to say one interface between the two sleeves and one interface between the first sleeve and the cable and flexible tube. Therefore it is possible to dispense with one interface in comparison to the prior art (in this context, see FIG. 2). This makes it possible to simplify the assembly process, and the reduction in the number of interfaces generally also results in improved robustness.

The electronic component is preferably a receiver. An external receiver unit of a hearing aid, for example, can therefore profit from the invention.

In one specific embodiment, the two sleeves overlap at their connection point. This has advantages particularly with respect to assembly, but also with respect to the strength of the apparatus.

The two sleeves can be welded to one another. Laser welding is particularly suitable for connection of the two sleeves.

The two sleeves advantageously have different optical absorption coefficients at the same wavelength. This makes it possible during laser welding, for example, for a laser to pass through one sleeve and to melt the other.

It is particularly advantageous for the two sleeves to be composed of materials whose basic component is the same plastic. In this case, the two sleeves can be better adhesively bonded or welded to one another.

Furthermore, a connection piece, to which an earpiece can be fitted, can be integrally formed on the second sleeve. The sleeve therefore has the additional functionality of an adaptor for an earpiece.

In particular, the connection piece may be spherical. This makes it possible to individually adjust the angle of the earpiece relative to the receiver.

According to a further preferred embodiment, an earwax protection device can be integrated in the connection piece. This makes it possible to further reduce the number of parts in the electronic apparatus.

In one specific embodiment, the hearing apparatus component is a part of a hearing aid which has a housing with signal processing elements and has a housing-external receiver as the electronic apparatus.

Other features which are considered as characteristic for the invention are set forth in the appended claims.

Although the invention is illustrated and described herein as embodied in an electronic apparatus for connection to a hearing apparatus component with a two-part sleeve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
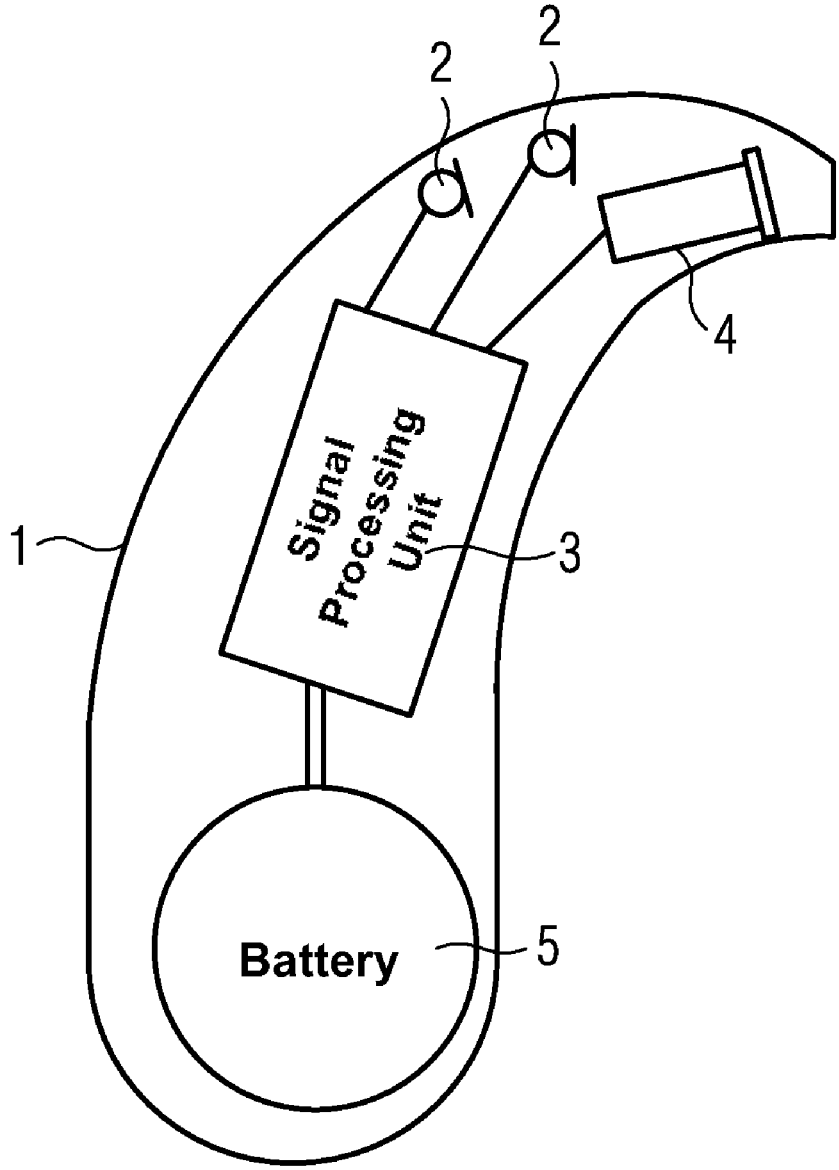
FIG. 1 PRIOR ART
FIG. 1 is an illustration of a basic configuration of a hearing aid according to the prior art.
Figure 2:
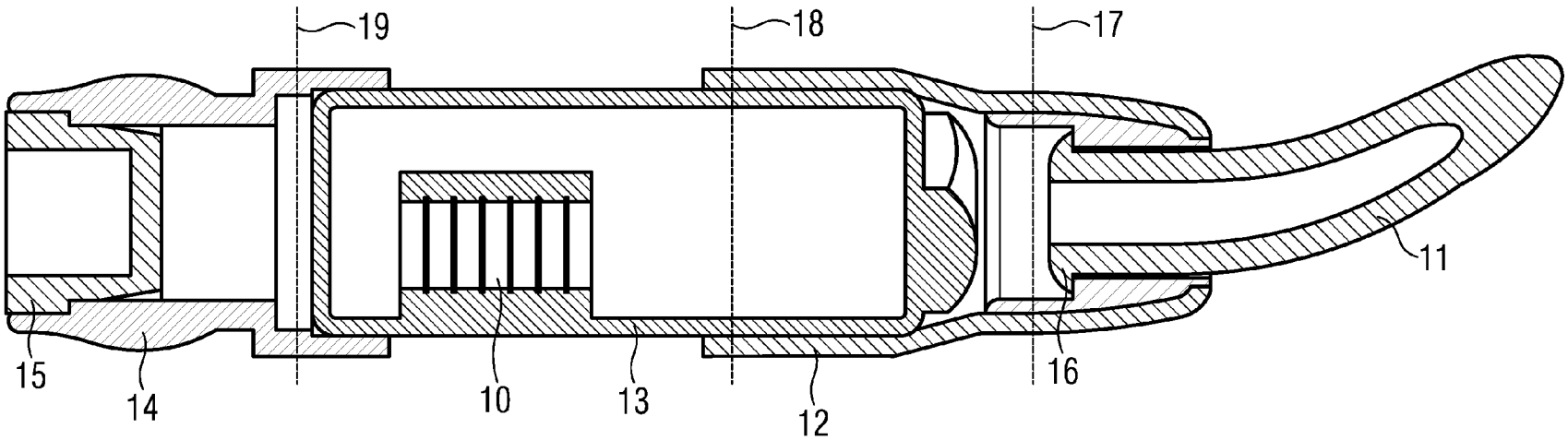
FIG. 2 PRIOR ART
FIG. 2 is a diagrammatic, sectional view of an external receiver of a hearing aid according to the prior art.

The exemplary embodiments described in more detail in the following text represent preferred embodiments of the present invention. Referring now to the figures of the drawing in detail and first, particularly, to FIG. 3 thereof, there is shown a cross section through an external receiver of a type of hearing aid according to the invention. Most components are identical to those of the receiver in FIG. 2. In this context, reference is therefore made to the above description relating to FIG. 2.

An electronic apparatus or "housing-external" electronic apparatus 24 for connection to a housing or hearing apparatus component 25 including signal processing elements 26 is provided. The electronic apparatus 24 has an electronic component 27, and a cable 28, which is connected to the electronic component 27.

The essence of the invention is that the number of interfaces between the flexible tube 11 and the connection piece 14 is reduced to two. The first interface, that is to say the connection 17, remains identical to that in the case of the known receiver shown in FIG. 2. In particular, a cable 28 is inserted into the flexible molded tube 11 and leads to the receiver 10 in the receiver housing 13. The somewhat thicker flexible tube end piece 16 is molded on at the end of the flexible molded tube 11. The first sleeve 12 is connected in an interlocking manner and/or with a friction fit to the flexible tube end piece 16 and therefore forms the first interface, or the first connection 17.

Figure 3:
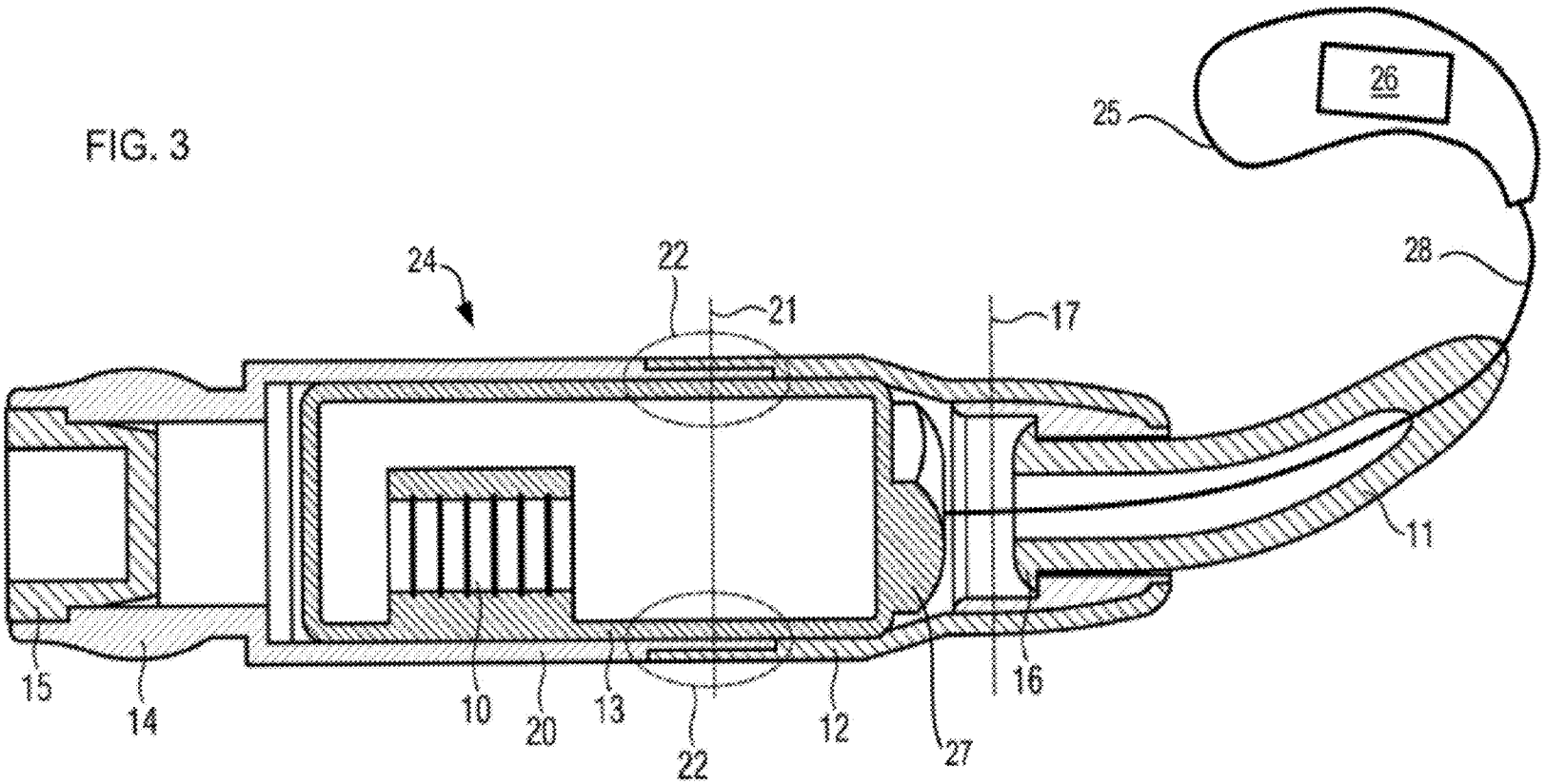
FIG. 3 is a diagrammatic, sectional view of a configuration of an external receiver of a hearing aid according to the invention.

The second connection 18 (plastic holder 12 to the receiver inner housing 13) and the third connection 19 (receiver inner housing 13 to the second sleeve 20 and connection piece 14) are now combined to form one connection 21, as shown in the example in FIG. 3. This is achieved by plugging the second plastic sleeve 20 onto the receiver inner housing 13 of the receiver from the opposite side, with the sleeves 12 and 20 being chosen to be sufficiently long that they touch one another, or overlap, in the plugged-on state. In the example shown in FIG. 3, an overlap 22 results when the two sleeves 12, 20 are in the plugged-on state, in which overlap 22, the first sleeve 12 rests radially over the second sleeve 20 over a certain axial area. The wall thickness of the sleeves 12, 20 can be appropriately reduced in this overlap area, such that the overall wall thickness in the overlap area corresponds approximately to that of the sleeves 12 and 22.

In one specific development, the plastic holder or the first sleeve 12, which is hung on the flexible molded tube 11, can be lengthened such that more than half of the overall length of the receiver inner housing 13 of the receiver 10 can be inserted into the first sleeve 12. This results in better lever ratios during insertion and removal of the external receiver into and from the auditory canal, thus making it possible to better avoid damage.

The two sleeves 12 and 20 therefore represent housing halves, and the connection 21 can be regarded as a housing interface. The plastic of the sleeves 12, 20 is chosen such that a connection can preferably be achieved by a laser welding process.

In this case, the second sleeve 20 consists of an injection-molded part, in which the spout, that is to say the connection piece 14, is integrated. Furthermore, the earwax protection device or contamination protection device 15 can be integrated directly in the connection piece 14. The protection requirements are met by a directly injection-molded grid in the front area of the spout.

By way of example, the spout may consist of a sphere which can be clicked into a ring adaptor. This sphere may be manufactured from various materials such as metals, or else from plastics. In this case, the sphere material must be highly wear-resistant and must have a high breaking strain. Inter alia, suitable plastics for this purpose include PEEK or LCP. One advantage of manufacturing the sphere from plastic is that the sphere and the outer housing of the receiver, that is to say the two sleeves 12 and 20 together with one another, can be formed as a unit composed of an identical material, thus making it possible to optimize the mechanical reliability of the overall system. This makes it possible to avoid problematic interfaces between different materials. Furthermore, a weak point of virtually any desired strength can be applied in this way.

As already mentioned, the housing interface 21 may be implemented such that the overlapping sleeves 12 and 20 are connected to one another by a laser welding process. However, this is dependent on the melting temperatures of the two partners of the joint being as close to one another as possible. This can be achieved particularly easily by the two joint partners being based at least on the same plastic. A further precondition for laser welding is that the two joint partners have optical absorption characteristics which are as different from one another as possible. This can be achieved for virtually any plastic by different types and/or concentrations of fillers. The light can then pass through the upper layer, essentially melting the lower layer.

Figure 4:
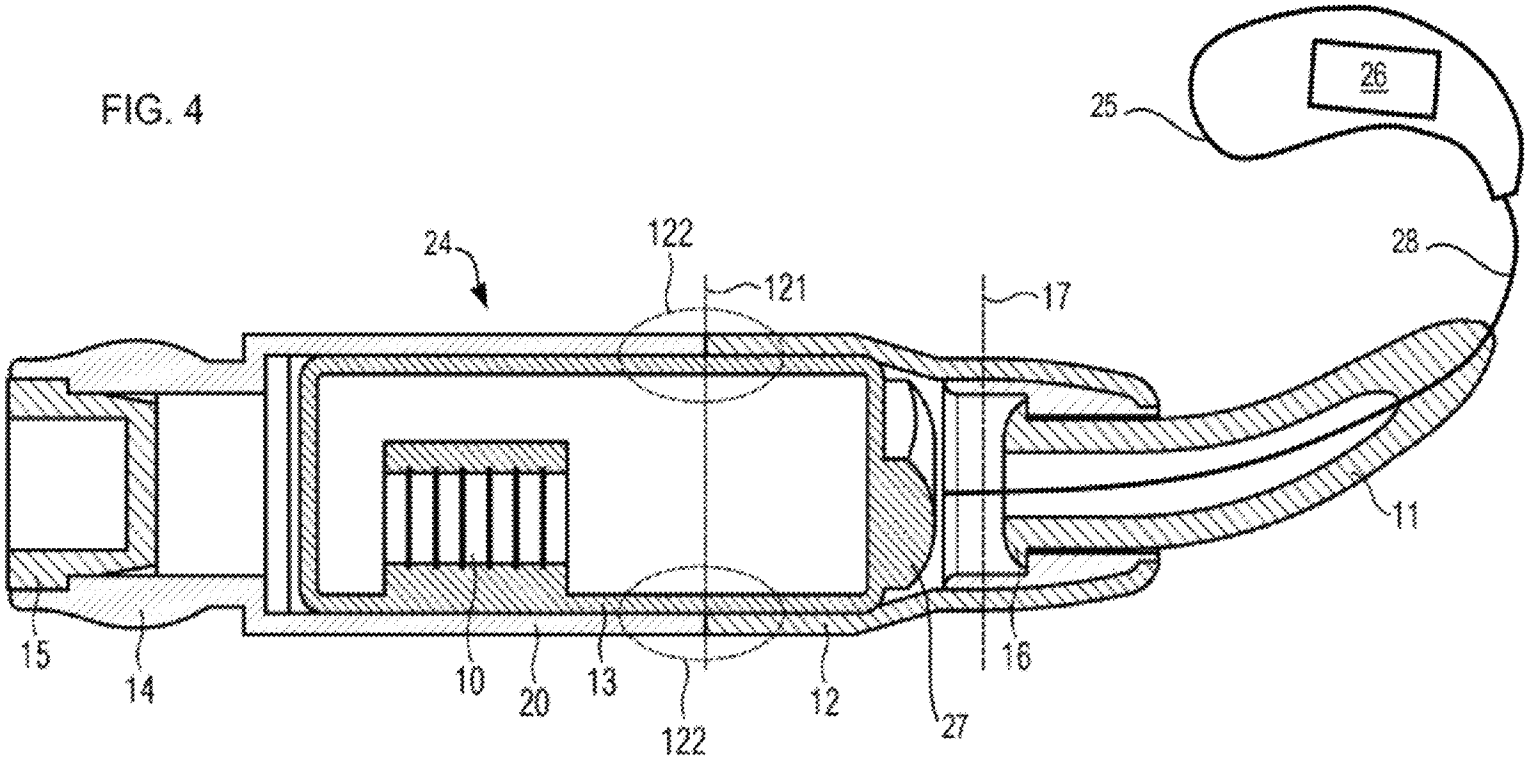
FIG. 4 is a diagrammatic, sectional view of the configuration of the external receiver in which the two sleeves are butt-welded to one another according to the invention.

In one alternative embodiment as shown in FIG. 4, the two sleeves 12 and 20 (the components which essentially match those in FIG. 3 are provided with the same reference symbols) do not overlap in the area of their abutting ends 122. In fact, they are in this case connected to one another "by a butt joint" at their connection point 121, preferably being welded to one another by laser welding. In this case, the two sleeves 12 and 20 may than also have a similar or the same absorption coefficient.

The advantages of the outer housing of the receiver according to the invention are that the connection of the external receiver on the one hand to the flexible molded tube 11 and on the other hand to the spout or the connection piece 14 by laser welding can be implemented for an entire system composed of plastic, which directly contains the spout. The advantages of this connection capability are that, in comparison to known solutions, it requires one interface less, thus reducing the risk of mechanical failure. In addition to this, in the proposed connection, it is fundamentally normal for the interface which in fact represents one possible weak point to be located at virtually any desired point over the length of the external receiver, in order to achieve optimized, low lever forces on the connection seam. Reducing the lever effect additionally greatly reduces the risk of fracture when the spherical adaptor is pulled out.

One advantage of the use of plastic laser welding in contrast to the present metal spot welds is that laser welding produces a continuous seam which therefore hermetically seals the receiver against external loads. This therefore reduces the damage to the receiver as a result of the influence of sweat, etc. Furthermore, a continuous connection is mechanically more robust than a spot weld.

In addition, it is highly advantageous that the earwax protection device in the present variant need no longer be installed in the form of a separate part, but is directly integrated in the sphere spout. On the one hand, this once again ensures greater mechanical robustness, while on the other hand improving the user-friendliness, since a further process step for construction of the external receiver unit can be saved.

A further advantage can be considered to be that a better "wearing comfort" can be achieved when using only one standard material, and no metal-plastic junction comes into contact with the hearing-aid wearer. Since, in addition, no metal comes into contact with the skin, it is possible to avoid allergy problems (for example resulting from nickel). There is therefore no longer any need for the gold-plating that is currently used on the receiver. Furthermore, the laser welding of the two plastic halves avoids the adhesive bonding process, which represents a mechanical weak point because of the low chemical stability of adhesive joints. Furthermore, there is also no risk of the flexible molded tube being blocked by adhesives, because the receiver can be inserted virtually freely into the plastic holder and need not be held by any adhesives or cast resins. This allows the receiver to be ventilated through the flexible molded tube without any problems. Furthermore, the use of plastics as a connection unit allows a virtually free choice of colors, in which the case the only factor that need be considered is the laser weldability.

The invention claimed is:

1. An electronic apparatus for connection to a hearing apparatus component, the electronic apparatus comprising:

an electronic component;

a cable connected to said electronic component and configured to be connected to the hearing apparatus component;

a first sleeve disposed around a part of said electronic component and a part of said cable and mechanically connects said electronic component and said cable;

a second sleeve surrounding a further part of said electronic component, said first sleeve and said second sleeve are coaxially directly connected to one another such that said first and second sleeves together also completely surround said electronic component in an axial direction; and said first and second sleeves and welded to one another.

2. The electronic apparatus according to claim 1, wherein said electronic component is a receiver.

3. The electronic apparatus according to claim 1, wherein said first and second sleeves are butt-welded to one another at a connection point.

4. The electronic apparatus according to claim 1, wherein said first and second sleeves overlap at a connection point.

5. The electronic apparatus according to claim 1, wherein said first and second sleeves have different optical absorption coefficients at a same wavelength.

6. The electronic apparatus according to claim 1, wherein said first and second sleeves are composed of materials whose basic component is an identical plastic.

7. The electronic apparatus according to claim 1, further comprising a connection piece, to which an earpiece can be fitted, is integrally formed on said second sleeve.

8. The electronic apparatus according to claim 7, wherein said connection piece is spherical.

9. The electronic apparatus according to claim 7, further comprising an earwax protection device integrated in said connection piece.

10. A hearing aid, comprising:

a housing having signal processing elements and being a hearing apparatus component; and a housing-external electronic apparatus coupled to said hearing apparatus component, said housing-external electronic apparatus including:

an electronic component;

a cable connected to said electronic component;

a first sleeve disposed around a part of said electronic component and a part of said cable and mechanically connects said electronic component and said cable;

a second sleeve surrounding a further part of said electronic component, said first sleeve and said second sleeve are coaxially directly connected to one another such that said first and second sleeves together also completely surround said electronic component in an axial direction; and said first and second sleeves are welded to one another.

* * * * *